United States Patent [19]

Etchell et al.

[11] 4,304,182

[45] Dec. 8, 1981

[54] NO-LOCK PRINTING PLATE ASSEMBLY USING FLEXIBLE PLATES

[75] Inventors: Gordon Etchell, Downers Grove; Cyril W. Frank, Brookfield, both of Ill.

[73] Assignee: Pathfinder Graphic Associates, Inc., Berwyn, Ill.

[21] Appl. No.: 186,601

[22] Filed: Sep. 12, 1980

[51] Int. Cl.[3] ..... B41F 27/12

[52] U.S. Cl. ..... 101/415.1

[58] Field of Search ..... 101/415.1; 51/368, 369

[56] References Cited

U.S. PATENT DOCUMENTS 2,621,592 12/1952 Faeber ..... 101/415.1

3,108,538 11/1963 Barnes ..... 101/415.1

FOREIGN PATENT DOCUMENTS 1233893 6/1971 United Kingdom ..... 101/415.1

*Primary Examiner*—Edgar S. Burr

*Assistant Examiner*—D. J. Isabella

*Attorney, Agent, or Firm*—Leydig, Voit, Osann, Mayer & Holt, Ltd.

[57] ABSTRACT

A "no-lock" printing plate assembly including a plate cylinder having a smooth plate supporting surface interrupted by a narrow axial groove having parallel side walls terminating in leading and trailing edges to form a gap, the side wall adjacent the leading edge presenting a flat angularly undercut end face. A single register pin is rigidly anchored perpendicular to the undercut end face. The plate is formed of a thin sheet of resilient material having a first bend at each end spaced from the leading and trailing edges of the plate to define respective leading and trailing edge portions. The leading and trailing edge portions have alined notches dimensioned to register with the pin. The edge portions are spaced and dimensioned for insertion into the gap into a condition in which the first bends are peripherally spaced from one another to provide clearance between them. At least one of the edge portions of the plate has an acute second bend parallel to the first bend and spaced a short distance therefrom to provide a reversely bent lip of a width greater than the width of the groove sprung outwardly to form a resilient bridge between the side walls of the groove for frictional engagement. A second cylinder running in contact with the plate cylinder "irons" the plate into intimate engagement with the plate cylinder, cyclically renewing a vacuum seal between them.

6 Claims, 11 Drawing Figures

NO-LOCK PRINTING PLATE ASSEMBLY USING FLEXIBLE PLATES

In printing, and particularly in lithographic printing, flexible plates are used and rather elaborate lock-up mechanisms are resorted to for clamping and tensioning the leading and trailing edges of the plate and for establishing and maintaining a condition of register. In British Pat. No. 1,233,893 it is proposed that mechanical lock-up devices be dispensed with and that the leading and trailing edges of the plate simply be tucked into an angularly cut groove of double the plate thickness. It is proposed that a single slot be provided, for registering purposes, at the leading edge of the plate. A study of the structure disclosed in the British patent has shown that the system is not practical for a number of reasons, resulting in the improved construction disclosed in our prior application Ser. No. 115,101 filed Jan. 24, 1980. In the latter construction the plate is bent over, or crimped, adjacent the ends to define leading and trailing edge portions which are spaced and dimensioned for insertion into the gap into a non-bottoming condition in which the bends are peripherally spaced from one another to provide clearance between them. The bend adjacent the trailing edge of the plate is bent at a sufficiently wide obtuse angle so that it is outwardly sprung causing the trailing edge of the plate to be in continuous resilient pressing engagement upon the leading edge portion to insure that the leading edge portion is maintained in sharply bent condition seated in registered condition against the undercut end face. The surface of the cylinder and the undersurface of the plate are both sufficiently smooth so that during successive revolutions of a cooperating cylinder the plate is "ironed" into intimate engagement with the plate cylinder to take up at least a portion of the clearance between the bends and to form a periodically renewed vacuum seal tending to hold the plate in position notwithstanding the effect of centrifugal force tending to dislodge it. Constant axial register of the plate is assured by forming a registering notch in the trailing as well as the leading edge. While our prior application discloses a printing plate assembly which is a distinct improvement over the assembly disclosed in the British patent, nevertheless a certain amount of reliance must be placed upon the material of which the plate is made, that is, it works best where the plate is of metal, resilient, and relatively stiff.

Accordingly, it is an object to provide an improved no-lock printing plate assembly having means for developing a reliably high level of friction between the leading and trailing edges of the plate and the side walls of the groove. It is a general object to provide a no-lock assembly in which the edges of the plate are retained more reliably than heretofore, particularly at maximum rotative speeds.

It is another object of the present invention, related to the foregoing, to provide a no-lock printing plate assembly which produces reliable retention over a wide range of printing plates which may be used with printing plates and which vary in thickness, elastic modulus, and material of construction, being applicable, indeed, to plates of plastic in addition to those formed of resilient metal.

It is a general object to provide a no-lock printing plate assembly in which reliable retention is achieved without addition of any locking elements and at only negligible cost as compared to the closest prior techniques.

Other objects and advantages of the invention will become apparent upon reading the attached detailed description and upon reference to the drawings in which.

While the invention has been described in connection with certain preferred embodiments, it will be understood that we do not intend to be limited by such embodiments but intend, on the contrary, to cover the various alternative and equivalent forms of the invention included within the spirit and scope of the appended claims.

Figure 1:
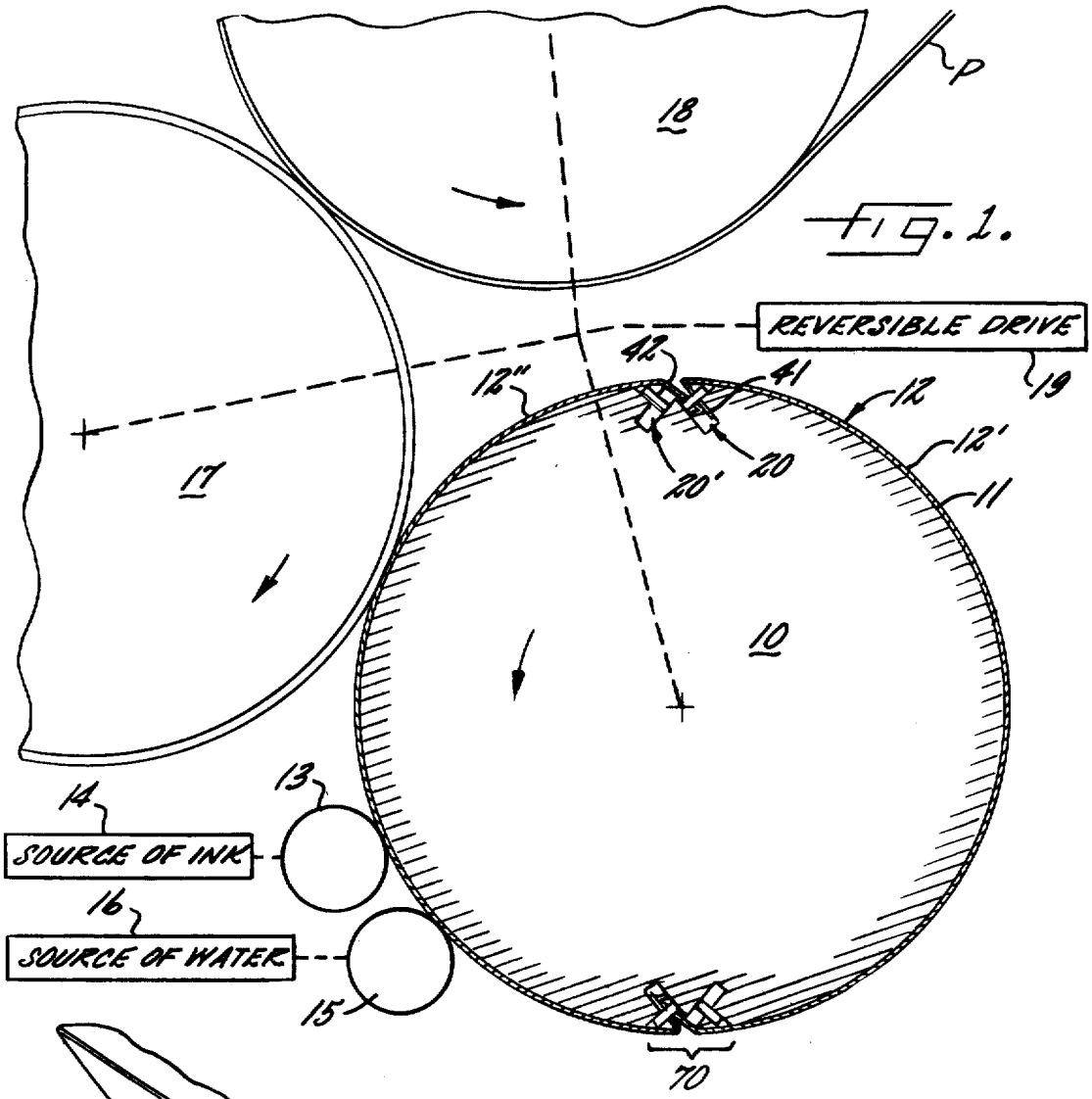
FIG. 1 shows the invention applied to a web fed lithograph press including a plate cylinder, blanket cylinder and impression cylinder.

Turning now to FIG. 1 there is shown a printing cylinder 10 providing a smooth plate supporting surface 11 carrying a flexible plate 12 of resilient material. The plate, in this embodiment, is of the lithographic type in rolling engagement with an ink form roller 13 having a source of ink 14 and with a water form roller 15 coupled to a source of water 16, both well understood in the art. In running engagement with the inked and moistened plate is a blanket cylinder 17 surfaced with a resilient blanket which takes the inked image from the surface of the plate, transferring, or offsetting, it onto a web of paper P which is supported upon an impression cylinder 18. All three of the cylinders 10, 17, 18, and elements of the ink and water supply systems as well, are synchronously coupled to a reversible press drive mechanism indicated generally at 19.

In carrying out the invention the surface of the plate cylinder 10 is interrupted by a narrow axial groove having parallel side walls terminating in leading and trailing edges spaced parallel to one another to form a gap. The side wall adjacent the leading edge presents a flat, angularly undercut end face making an acute angle with respect to the outer surface, and a register pin is rigidly anchored in the undercut end face. Thus we provide a groove 20 having parallel side walls: a "leading" side wall 21 and a "trailing" side wall 22, with a bottom, or root, 23. The side wall 21 presents an end face making an acute angle a with respect to the outer surface of the cylinder, an angle which may be on the order of 50 degrees. The side walls terminate in leading and trailing edges 25, 26 defining between them a gap G. For purposes of registering the plate a register pin is rigidly anchored with respect to the end face 21 and projects at right angles thereto in a plane which is transverse to the cylinder axis. The pin, indicated at 30, is snugly fitted in a bore 31 which, as shown, is in communication with the plate supporting surface 11, permitting installation of the pin from the direction of the supporting surface. The unoccupied space at the outer end of the pin is preferably plugged so as to restore the integrity of the surface.

Above we have considered only a single, or right-hand, groove 20 and its associated elements. It will be understood, however, that a companion groove will be provided, which is a mirror image of that described, for use where the plate cylinder is capable of being driven in the reverse direction by the drive 19. The companion groove is indicated at 20' and associated parts are identified by corresponding reference numerals with the addition of a prime.

The plate 12, which is wrapped about the plate cylinder 10, is formed of a thin sheet of resilient material, for example, a thin sheet of metal having a central or printing portion 40, a smooth undersurface, and having a first bend at each end spaced from the leading and trailing edges of the plate to define respective leading and trailing edge portions 41, 42. The leading and trailing edge portions have alined longitudinal notches 43, 44 of the same axial width as the pin 30. The bend adjacent the leading edge of the plate, indicated at 45, is in the form of a crease, or crimp, making a sharp acute angle so that when the leading edge portion 41 of the plate is hooked over the leading edge 25 of the cylinder it engages the undercut end face 21 with the notch 43 in both circumferential and axial register with the end face and the pin. The bend at the trailing edge of the plate, and which is indicated at 46, is in the form of a wide obtuse angle b (FIG. 4) so that when the trailing edge portion 42 of the plate is tucked into the groove 20 it extends beyond the register pin with the notch 44 therein in axial register with the pin.

In practicing the invention the gap G in the cylinder has a width which is substantially greater than twice the thickness of the plate and the edge portions of the plate 41, 42 are spaced and dimensioned for insertion successively into the gap into a non-bottoming condition in which the first bends 45, 46 are peripherally spaced from one another to provide clearance between them, as indicated at CL, in an amount which is less than the gap width G. Such clearance is desirable to accommodate the slight effective "lengthening" of the plate which occurs when the plate is installed and in running engagement with a cooperating cylinder, in the present instance the blanket cylinder 17. During the initial revolutions of the cylinders the plate is "ironed" into increasingly intimate engagement with the smooth outer plate supporting surface accompanied by the taking up of at least a portion of the clearance CL between the bends 45, 46. Because the gap G is substantially greater than twice the plate thickness and because of the clearance which has been provided, the trailing edge of the plate has "somewhere to go" as the plate is intimately seated on the surface of the plate cylinder.

In accordance with the present invention at least one of the edge portions 41, 42 of the plate has an acute "second" bend parallel to the first bend and spaced a short distance therefrom to provide a reversely bent lip of constant width, the lip being sprung outwardly at the second bend and of a width wider than the width of the groove so as to form a resilient bridge between the side walls of the groove, developing a force, with accompanying friction, against the side walls for retention of the plate in the groove. Thus, as shown in the drawings, there is provided on the trailing edge portion 42 of the plate a lip 50 formed by a "second" bend or crimp 51. The lip 50, in the preferred embodiment, is bent "inwardly" with respect to the outer surface of the plate.

In practicing the invention the lip is acutely bent and of a width W (see FIG. 4) which is moderately wider than the perpendicularly measured net width of the groove. The lip is bent to occupy an unstressed (dot-dashed) position at acute angle d, but when the trailing edge portion 42 occupies its inserted position the lip is squeezed inwardly to a more acute angle c, thereby resulting in a force F applied mutually outwardly, along lines of action 53, 54, against the side walls 21, 22 of the groove.

The force F developed by the inwardly turned lip pressing mutually outwardly against the groove side walls is found to produce several distinct advantages. In the first place it provides more positive retention against the dislodging effect of centrifugal force acting upon the plate. Thus the force F is accompanied by development of friction both along the remote edge of the plate and along the region of the second bend. This retaining frictional force greatly exceeds the frictional force developed by the springing of the plate edge portion in the structure disclosed in our co-pending application mentioned above. The frictional force is enhanced by the geometry of the lip which is only moderately wider than the groove and which provides a ratcheting, hooking or "toggle" action upon efforts to withdraw the trailing edge portion of the plate from seated position. Such toggle action may be visualized by noting that a high degree of frictional force along the line of action 53, will upon retraction tend to make the lip twist into a more on-center condition in which the edges of the lip "bind" against the walls of the groove. In practice the width W of the lip may be from 10 percent to 20 percent greater than the perpendicularly measured net width of the groove, with the toggle action being particularly achieved at the lower end of this range. Because of the toggle action the amount of force required to insert the trailing edge portion of the plate is less than the amount of the resulting retaining force. Nevertheless, the retaining force may be readily overcome when the plate is removed as long as the surface of the side walls 21, 22 of the groove are machined smooth. It follows from this that retention may be made even more secure, if desired, by intentionally roughening the side walls.

In accordance with one of the aspects of the present invention, the remaining one of the edge portions of the plate, here end portion 41, extends sufficiently deeply into the groove so as to be sandwiched between the lip and the adjacent side wall of the groove and thereby held in seated position, frictionally captive. Thus in the present instance the leading edge portion 41 of the plate is made of a length L, measured longitudinally of the plate, which is short of striking the bottom of the groove but which is sufficiently long so as to extend beyond the line of engagement 54 of the right-hand side of the lip 50. The force F therefore is not only effective to keep the leading edge portion of the plate flatly seated against the undercut end face 21, and therefore reliable registered with the pin, but any tendency toward withdrawal of the leading edge of the plate as might occur at high speed and where a lesser degree of undercut is employed, is frictionally inhibited.

One of the benefits of the present invention is that reliable retention is secured without undue dependence upon the elastic modulus, or stiffness, of the material of which the plate is formed. Using the present invention appreciable forces F can be developed even using plates which are relatively thin and having a low elastic modulus. Indeed, the invention is not limited to use with plates formed of metal but is, because of the acutely bent lip, applicable to plastic plates which are inherently less stiff than their metal counterparts. When using plates formed of plastic it will usually be found desirable to make the lip a little narrower than would be employed in the corresponding metal plate in order to provide an increased degree of toggle action.

Figure 4:
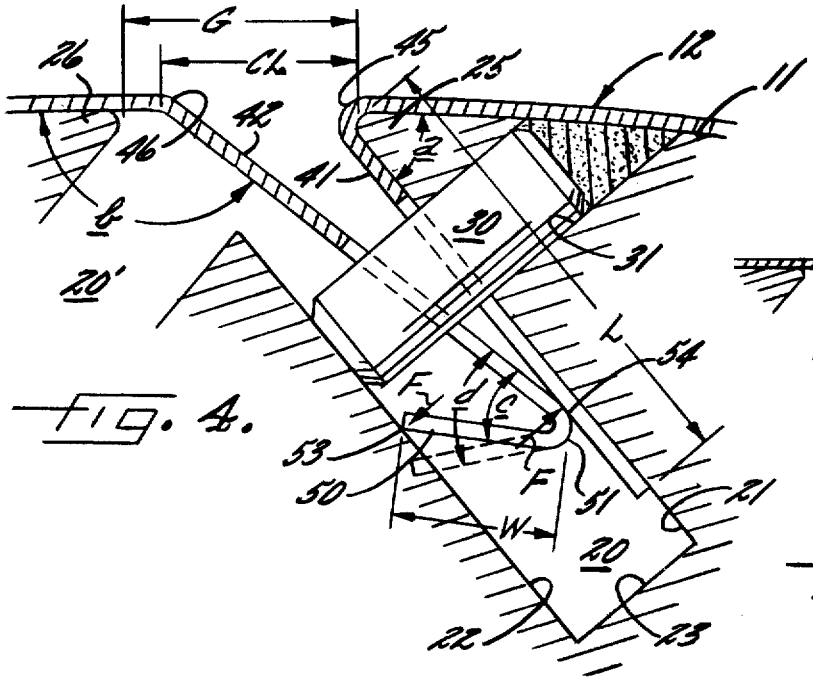
FIG. 4 is a diagram based upon FIG. 3 to illustrate more clearly the geometry of the construction, including the inwardly bent lip.
Figure 5:
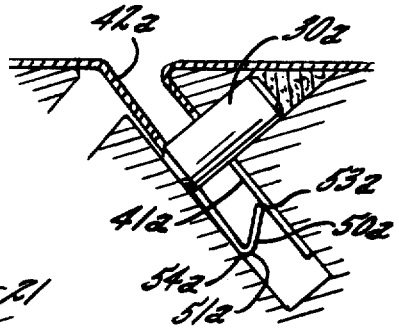
FIG. 5 is a diagram similar to FIG. 4 but showing the lip on the trailing edge outwardly bent.

While the invention has been described in FIGS. 1 to 4 in connection with a lip formed by an inward second bend along the trailing edge portion of the plate, the invention is not limited thereto and includes the bending of the lip in the opposite direction, that is outwardly, as illustrated in FIG. 5 where corresponding reference numerals denote corresponding parts with addition of subscript a. Thus the lip 50*a*, instead of being bent to the left as in FIG. 4, is bent to the right so that the free edge of the lip indicated at 53*a* bears against the leading edge portion 41*a* of the plate to hold it in seated position.

Figure 6:
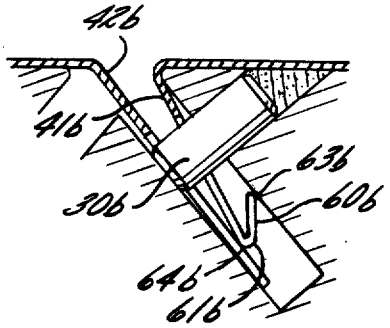
FIGS. 6 and 7 are views corresponding to FIGS. 4 and 5 but illustrating use of a lip on the leading edge of the plate.
Figure 7:
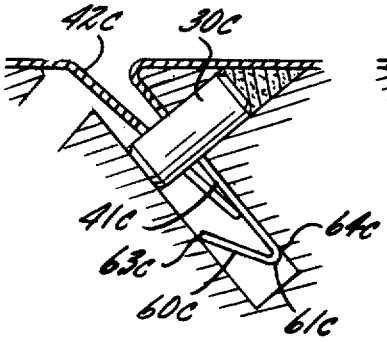

Also while the invention has been described in connection with a lip 50 formed on the trailing edge 42 of the plate, a lip 60 may, if desired, be formed on the leading edge 41 of the plate either inwardly bent at 61*b* as shown in FIG. 6 or outwardly bent as shown at 61*c* in FIG. 7. In FIG. 6 corresponding elements are indicated by corresponding reference numerals with addition of subscript b while in FIG. 7 the subscript c has been employed. It will be noted in FIG. 7 that the trailing edge portion 42*c* of the plate is not held captive by the lip 60*c*. The reason for this is that the end portion 42*c* is inserted last in installing a plate on the cylinder. Thus the arrangement in FIG. 7 is not quite as desirable as that in FIG. 6 although it provides a good retention where the plate is adequately stiff.

Figure 8:
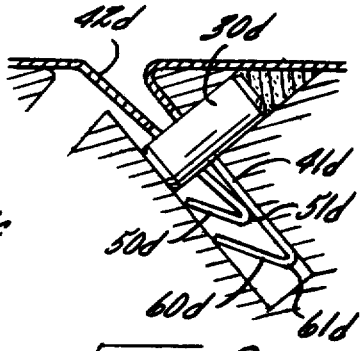
FIGS. 8 and 9 are diagrams showing the use of lips on both of the plate edges, bent both inwardly and outwardly.

In accordance with one of the more detailed aspects of the invention, retaining lips are provided along both the leading and trailing edge portions of the plate for separate, and cooperative, retention of the edge portions. Such arrangements are illustrated in FIGS. 8–11 inclusive where corresponding elements are denoted by subscripts d–g, respectively. In FIG. 8 the trailing edge portion 42*d* of the plate is provided with a lip 50*d*, similarly to the construction show in FIG. 4. However, the leading edge 41*d* is also provided with its own lip, indicated at 60*d*, which is dimensioned to occupy a lower position in the groove. The edge portions of the plate are not only separately retained by their individual lips but the upper lip, 50*d*, acts in a dual capacity to press against the leading edge portion of the plate to keep it in seated position as well as to provide augmented frictional retention.

Figure 9:
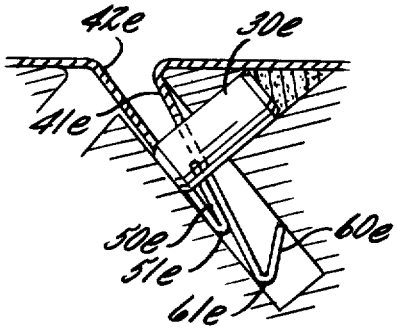

The structure shown in FIG. 9 differs from that in FIG. 8 simply in that the direction of the second bends are both reversed, but otherwise the features and advantages of the construction are substantially the same.

Figure 10:
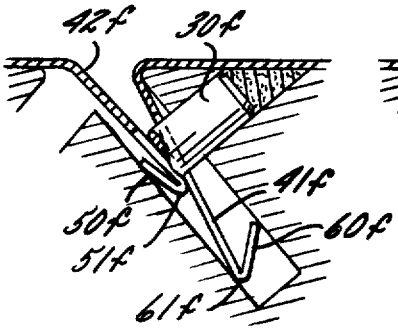
FIGS. 10 and 11 are diagrams corresponding to FIGS. 8 and 9 but show dual lips both of which are turned inwardly and outwardly in the respective views.
Figure 11:
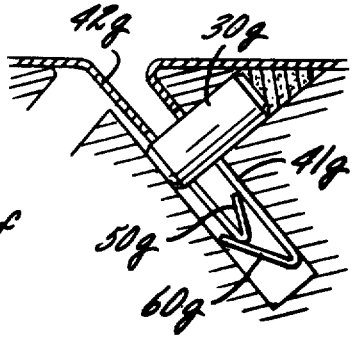

FIG. 10 shows an arrangement in which both of the edge portions of the plate are provided with respective lips 50*f*, 60*f* both of which are defined by a second bend in the inward direction (with respect to the outer surface of the plate), whereas in FIG. 11 the lips, respectively indicated at 50*g*, 60*g*, are both bent outwardly. Both of these embodiments provide superior retention.

Figure 2:
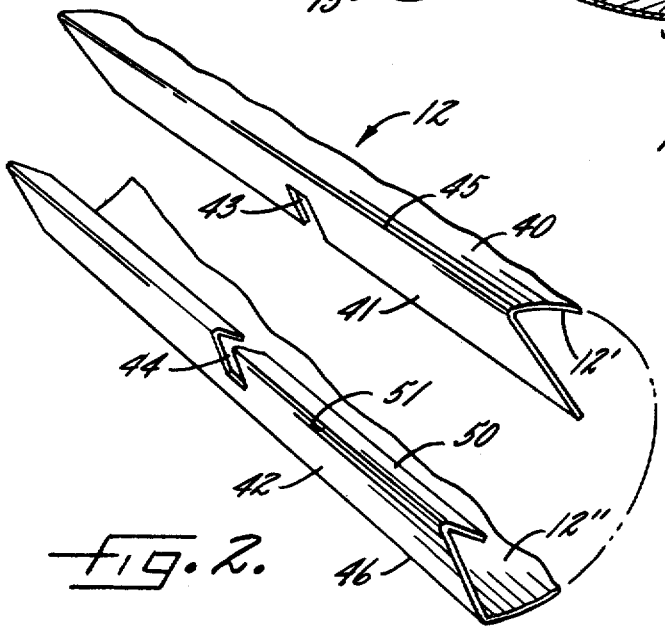
FIG. 2 is a fragmentary perspective showing the leading and trailing edge portions of the flexible plate.
Figure 3:
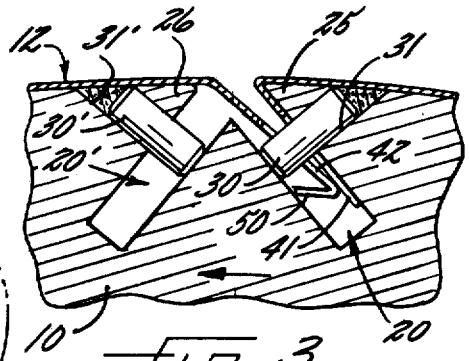
FIG. 3 is an enlarged cross sectional view based upon FIG. 1 showing the leading and trailing edge portions of the plate in seated condition.

Installation of the plate upon the cylinder follows the same procedure in all of the embodiments described above: The leading edge portion of the plate, indicated at 41, which is pre-bent into an acute angle, is simply hooked over the leading edge 25 of the gap, with the notch 43 thereof in engagement with the register pin 30. The plate is then wrapped around the cylinder and, as a final step, the trailing edge portion 42 of the plate is tucked into seated position in the groove, with its notch 44 engaging the same pin 30. In practice both of the notches 43, 44 may be centered along the edge of the plate as illustrated in FIG. 2 to mutually register with the pin 30 which is also centrally mounted. Installation is thus extremely simple. During the first few revolutions of the cylinders, because of the "ironing" effect of the impression cylinder 17, the plate will be intimately seated upon the surface of the plate cylinder resulting in apparent slight elongation of the plate as it tightens into position, such elongation being readily accommodated by the clearance CL shown in FIG. 4. between the bends in the plate. Such clearance has the additional advantage that it reduces the need for close tolerance in positioning the first bends 45, 46 with respect to one another. Removing the plate from the cylinder is an equally easy matter; the end portions of the plate are simply pulled in succession from the groove using a force adequate to overcome the lip-induced friction, applied by a hand held suction cup device.

While the use of the undercut and frictional retention which characterizes the present invention results in reliable retention, it is also a feature of the invention that the outer surface of the plate cylinder and the inner surface of the plate are smoothly finished so that after the plate has been initially "ironed" into seated position any tendency of the plate to become unseated is overcome by the existence of vacuum between the engaged surfaces, a factor more fully discussed in our copending application. Since the vacuum seal is constantly renewed at a high cyclical rate as the cylinders revolve, there is assurance that the plate will be maintained even at the highest speeds achievable in the state of the art. The presence of casual liquid enhances the sealing effect.

As a result of the provision of oppositely, and symmetrically, angled grooves 20, 20', the arrangement operates equally well in either direction of rotation. It is a feature of the present invention in one of its aspects that only a single pin is used along each edge in axially centered position and that single notches are formed in the respective leading and trailing edge portions of the plate. Where two pins 30, 30' are employed in adjacent grooves they both occupy centered positions alined in the same transverse plane with one another. This makes it possible for a plate to be reversed, end for end, while maintaining the condition of register for either direction of cylinder rotation.

The invention has been described thus far in terms of the unitary plate 12 having two ends adjacent to one another. However, the invention is not limited thereto and is equally applicable to plates arranged two, three, or even four "around." Indeed, FIG. 1 illustrates preferred "two around" installation in which the plate 12 may be considered to have two sections 12' and 12'' of equal arcuate length joined by the cylinder, and effectively forming a continuation of one another, by using a second retaining assembly indicated at 70 (FIG. 1). Such assembly may, in all respects, be identical to that which has just been described.

The invention has been discussed assuming that the platesupporting surface 11 is formed directly upon the cylinder 10 which is, indeed, preferred. However, if desired, and without departing from the invention, there may be interposed between the cylinder body and the plate an arcuate saddle which has grooves formed in its ends and in which the register pins are mounted. Use of a saddle and its retention are disclosed in our copending application to which cross reference is made. Such saddle may extend "one around" the cylinder body in a single tubular fashion or the saddle may be provided in adjacent arcuate sections either two, three or four "around" corresponding to the sections of the printing plate. For the purpose of reading and applying the claims appended hereto the saddle, if provided on a plate cylinder, shall be considered an integral part of the plate cylinder.

In the preferred form of the present invention the obtuse bend 46 in the trailing edge portion of the plate is imparted to the plate prior to installation on the cylinder. However, because of the shallow nature of the bend, which is widely obtuse, the "first bend" in the trailing edge of the plate may be simply that which occurs incident to installation of the plate.

The term "smooth" as used herein in reference to the surface of the plate cylinder and the surface of the underside of the plate is means the surfaces are sufficiently free of intentional patterning or interruption so as to preclude entry of any appreciable amount of air between the plate and its supporting surface during a revolution at operating speed. The term "parallel" as applied to the side walls of the groove which receives the end of the plate shall not be considered to require absolute parallelism or perfect flatness. It suffices, in the practice of the invention, for the surfaces to be generally parallel, and the degree of flatness is optional. The term "pin" as used herein is not limited to a cylindrical element but includes any projection employed for register purposes.

While the invention has been described in connection with use of a flexible plate on a lithograph press, it will be apparent that the invention is not limited to such a press and that the invention is applicable wherever a thin flexible printing plate is to be secured on a cylinder in a peripherally and axially registered condition with only a small amount of area being lost at the gap.

What we claim is:

1. A "no-lock" printing plate assembly comprising, in combination a drive, a plate cylinder coupled to the drive and having a smooth outer plate-supporting surface interrupted by a narrow axial groove having parallel side walls terminating in leading and trailing edges spaced parallel to one another to form a gap, the side wall adjacent the leading edge presenting a flat, angularly undercut end face making an acute angle with respect to the outer surface, a register pin rigidly anchored with respect to the undercut end face and projecting substantially at right angles thereto, a plate formed of a thin sheet of resilient material having a smooth undersurface and having a first bend at each end spaced from the leading and trailing edges of the plate to define respective leading and trailing edge portions, the width of the gap in the cylinder being substantially greater than twice the plate thickness, the edge portions of the plate being spaced and dimensioned for insertion successively into the groove into a non-bottoming condition in which the first bends are peripherally spaced from one another to provide clearance between them, both the leading and trailing edge portions having respective longitudinal notches alined with one another and of the same axial width as the pin, the leading edge bend forming an acute angle so that when the leading edge portion is hooked over the leading edge in circumferential register the notch therein is in axial register with the pin, the bend adjacent the trailing edge of the plate being in the form of an obtuse angle so that when the trailing edge portion of the plate is tucked into the groove it extends beyond the register pin with the notch therein in axial register with the pin, at least one of the edge portions having an acute second bend parallel to the first bend and spaced a short distance therefrom to provide a reversely bent lip of constant width, the lip being sprung outwardly at the second bend and of a width moderately wider than the width of the groove so as to form a resilient bridge between the side walls of the groove developing a force with accompanying friction against the side walls for retention of the plate in the groove, and at least a second cylinder in running engagement with the plate so that during the initial revolutions the smooth undersurface of the plate is ironed into increasingly intimate engagement with the smooth outer plate-supporting surface accompanied by the taking up of at least a portion of the clearance between the bends and cyclically renewing a vacuum seal under the plate tending to hold the plate in position notwithstanding the effect of centrifugal force tending to dislodge it.

2. The combination as claimed in claim 1 in which the width of the lip, measured longitudinally of the plate, exceeds the net width of the groove by an amount lying within the range of 10 percent to 20 percent.

3. The combination as claimed in claim 1 in which the remaining one of the edge portions of the plate extends sufficiently deeply into the groove so as to be sandwiched between the lip and the adjacent side wall of the groove and thereby held in seated position and frictionally captive.

4. The combination as claimed in claim 1 in which the lip is formed on the trailing edge of the plate.

5. The combination as claimed in claim 1 in which the lip is formed on the leading edge of the plate.

6. The combination as claimed in claim 1 in which the lip is formed on both the leading and trailing edges of the plate.

* * * * *